US009240639B2

(12) United States Patent
Tang et al.

(10) Patent No.: US 9,240,639 B2
(45) Date of Patent: Jan. 19, 2016

(54) CARD EDGE CONNECTOR WITH A LOCK MECHANISM

(71) Applicant: HON HAI PRECISION INDUSTRY CO., LTD., New Taipei (TW)

(72) Inventors: Wen-Jun Tang, Kunshan (CN); Xue-Wu Bu, Kunshan (CN); Yi-Lei Qin, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/299,425

(22) Filed: Jun. 9, 2014

(65) Prior Publication Data

US 2014/0364000 A1 Dec. 11, 2014

(30) Foreign Application Priority Data

Jun. 8, 2013 (CN) ..... 2013 1 0226932

(51) Int. Cl.
*H01R 12/70* (2011.01)
*H01R 13/629* (2006.01)

(52) U.S. Cl.
CPC ..... *H01R 12/7005* (2013.01); *H01R 13/62988* (2013.01)

(58) Field of Classification Search
USPC ..... 439/345, 157, 155, 160, 328
See application file for complete search history.

(56) References Cited

U.S. PATENT DOCUMENTS

| | | | | | |
|---|---|---|---|---|---|
| 4,898,540 | A * | 2/1990 | Saito | 439/153 |
| 5,302,133 | A * | 4/1994 | Tondreault | 439/157 |
| 5,443,394 | A * | 8/1995 | Billman et al. | 439/157 |
| 5,746,614 | A * | 5/1998 | Cheng et al. | 439/157 |
| 6,113,404 | A * | 9/2000 | Choy | 439/160 |
| 6,132,228 | A * | 10/2000 | Lang | 439/160 |
| 6,319,027 | B1 * | 11/2001 | Pickles et al. | 439/157 |
| D463,384 | S * | 9/2002 | Hu | D13/199 |
| 6,599,142 | B2 * | 7/2003 | Bu | 439/157 |
| 6,616,466 | B2 * | 9/2003 | Frantum et al. | 439/157 |
| 7,494,354 | B2 * | 2/2009 | Mon et al. | 439/160 |
| D627,740 | S * | 11/2010 | Wu et al. | D13/154 |
| 7,828,566 | B2 * | 11/2010 | Chen et al. | 439/157 |
| 7,922,506 | B1 * | 4/2011 | Harlan et al. | 439/160 |
| 7,955,098 | B1 * | 6/2011 | McKee et al. | 439/157 |
| 8,002,563 | B2 * | 8/2011 | Li et al. | 439/160 |
| 8,052,335 | B2 * | 11/2011 | Kasbeer-Betty et al. | 385/92 |
| 8,070,499 | B2 * | 12/2011 | Guan et al. | 439/155 |
| 8,535,077 | B2 * | 9/2013 | Shen et al. | 439/328 |
| 8,616,903 | B2 * | 12/2013 | Li et al. | 439/157 |
| 8,794,985 | B2 * | 8/2014 | Li et al. | 439/157 |

* cited by examiner

*Primary Examiner* — Alexander Gilman
(74) *Attorney, Agent, or Firm* — Wei Te Chung; Ming Chieh Chang

(57) ABSTRACT

A card edge connector assembly includes a connector with a central slot and a daughter card having an inserted end for being inserted into the central slot. The connector includes an elongated housing, a plurality of terminals retained in the elongated housing, and at least one lock mechanism for locking the daughter card. The lock mechanism has a locking portion for locking the daughter card and an elastic projection projects from the locking portion for downwardly pressing the daughter card. It can prevent the daughter card from shaking shake.

19 Claims, 7 Drawing Sheets

CARD EDGE CONNECTOR WITH A LOCK MECHANISM

BACKGROUND OF THE INVENTION

1. Field of the Invention

The present invention generally relates to a card edge connector and more particularly to a card edge connector with a lock mechanism.

2. Description of Related Art

U.S. Pat. No. 7,922,506, issued on Apr. 12, 2011, discloses a related card edge connector which includes an elongated insulative housing, a plurality of terminals retained in the insulative housing and a pair of lock mechanisms pivoted on two opposite ends of the housing. The lock mechanism has a locking portion for locking a daughter card. However, the lock mechanism using accounts the locking portion wear and tear, and then cause the daughter shaking.

Hence, an improved card edge connector is desired to overcome the above problems.

SUMMARY OF THE INVENTION

Accordingly, an object of the present invention is to provide a card edge connector having a higher electrical function.

To achieve the above object, a card edge connector, comprising an elongated insulative housing having a central slot for insertion of a daughter card and a pair of end portions located at opposite sides of the central slot respectively. A plurality of terminals retained in the insulative housing and protruded into the central slot for mating with the daughter card. At least one lock mechanism pivoted at one end portion for locking with the daughter card. The lock mechanism has a locking portion for locking the daughter card and an elastic projection projecting from the locking portion for downwardly pressing the daughter card.

Other objects, advantages and novel features of the invention will become more apparent from the following detailed description when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
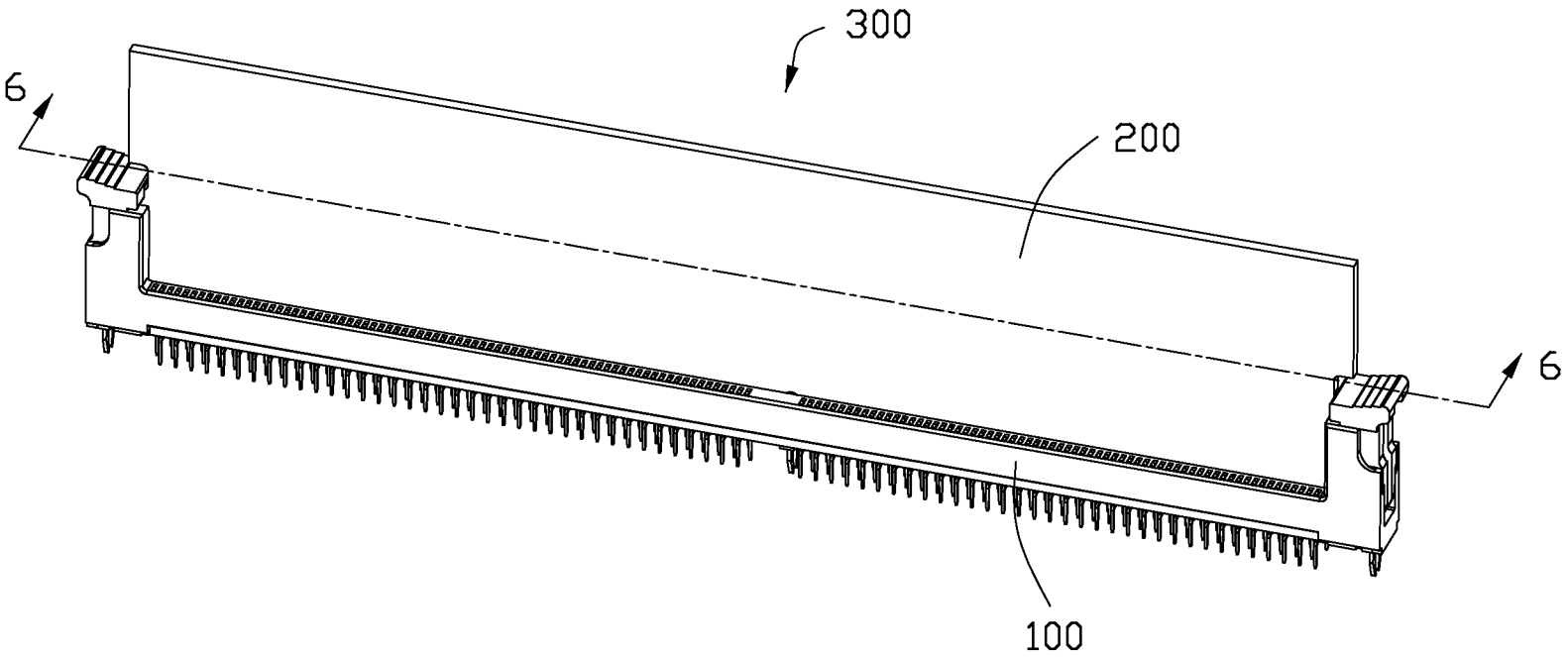
FIG. 1 is an assembled, perspective view of a card edge connector and a daughter card inserted into the card edge connector.

Reference will be made to the drawing figures to describe the present invention in detail, wherein depicted elements are not easily shown to scale and wherein like or similar elements are designated by same or similar reference numeral through the several views and same or similar terminology.

Figure 2:
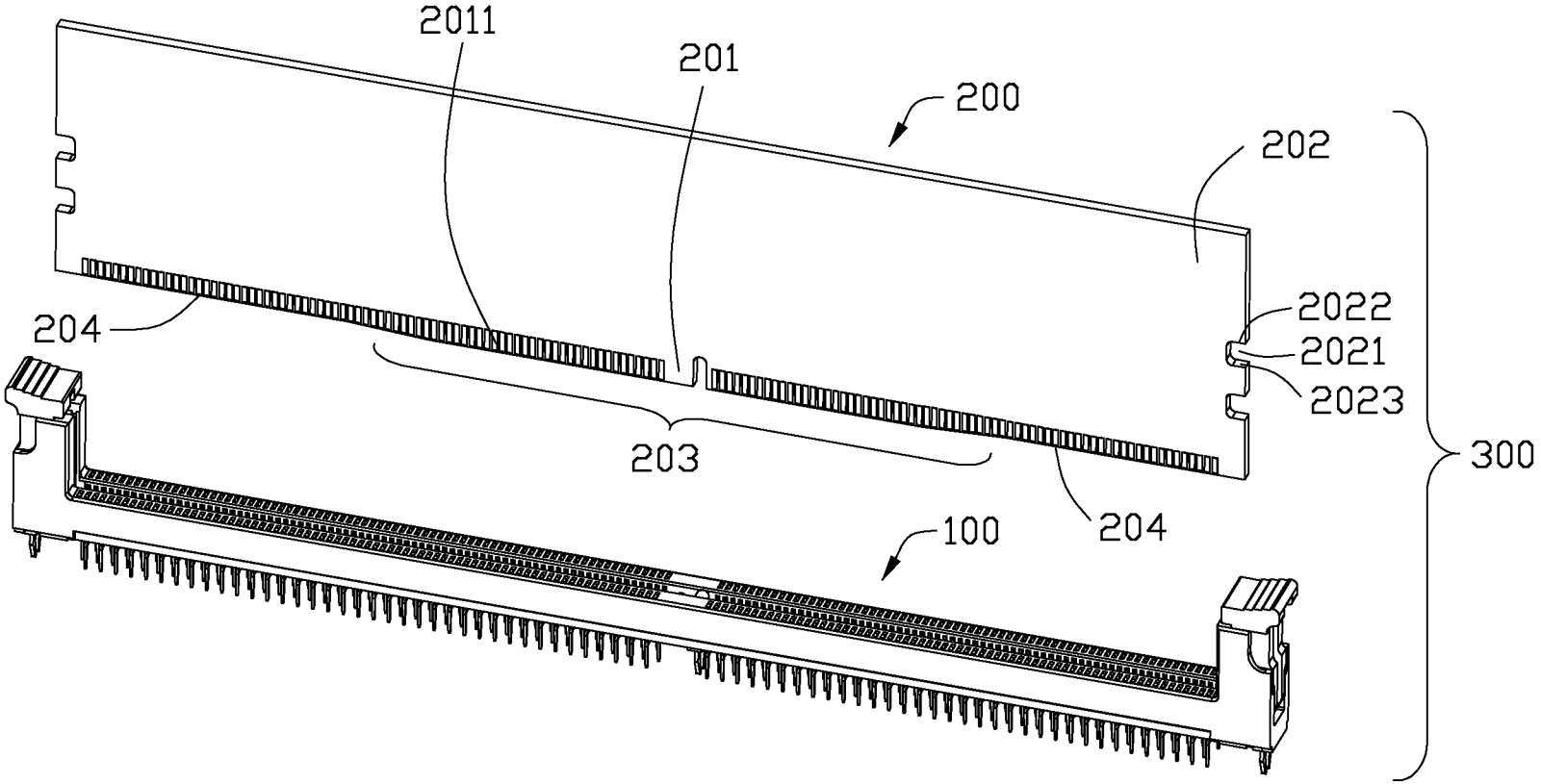
FIG. 2 is an assembled, perspective view of a card edge connector and a daughter card pulled out of the card edge connector.
Figure 3:
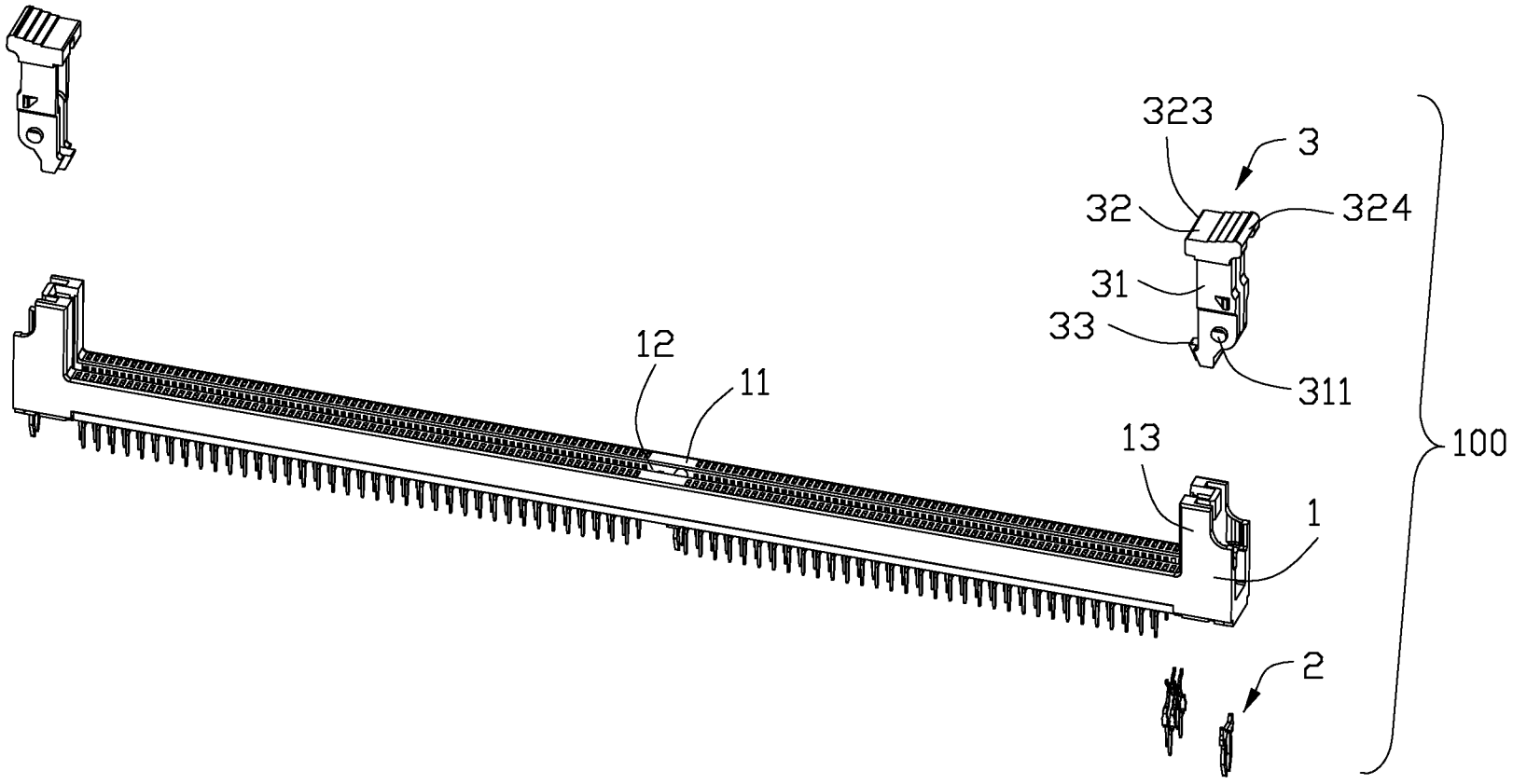
FIG. 3 is an explored, perspective view of the card edge connector according to a preferred embodiment of the present invention.

Referring to FIGS. 1 to 3, a card edge connector assembly 300 comprises a card edge connector 100 and a daughter card 200 received in the card edge connector 100. The card edge connector 100 comprises an elongated insulative housing 1, a plurality of terminals 2 are retained in the insulative housing 1, at least one lock mechanism or ejector 3 pivoted on a tower or an end portion of the housing 1 for locking with the daughter card 200.

Referring to FIG. 3, the elongated insulative housing 1 defines a mating face 11, a central slot 12 depressed from the mating face 11 for insertion of the daughter card 200 and two towers 13 located at opposite sides of the insulative housing 1 for receiving the lock mechanism 3. The lock mechanism 3 includes a main portion 31 defining an upper end and a lower end opposite to the upper end.

The lock mechanism 3, which is movable between an inner locking position and an outer unlocking position, further defines a locking portion 32 extended from the upper end of the main portion 31 for locking the daughter card 200 and an ejecting portion 33 extended from the lower end for ejecting the daughter card 200 out of the central slot 12, the daughter card 200 defines two opposite sides 202, at least one side 202 provided with an opening or notch 2021 for cooperating with the locking portion 32. The main portion 31 defines two protrusions 311 on opposite side surfaces and the tower 13 defines two pivoting holes (not shown) coordinating with the protrusion 311. The daughter card 200 defines a contacting end 201 and a plurality of gold-fingers 2011 are arranged on both sides of the contacting end 201.

Figure 4:
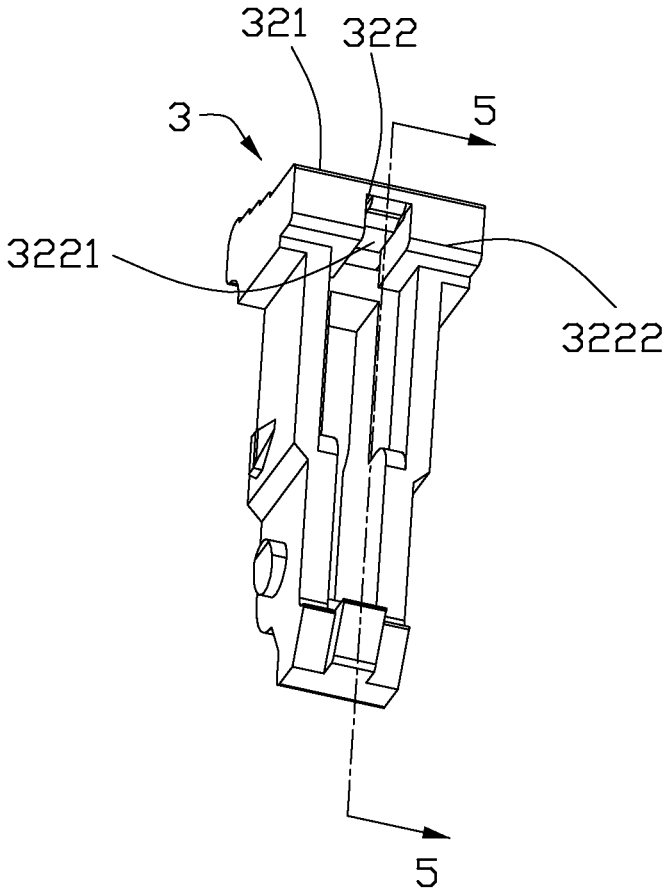
FIG. 4 is an explored, perspective view of the lock mechanism.
Figure 5:
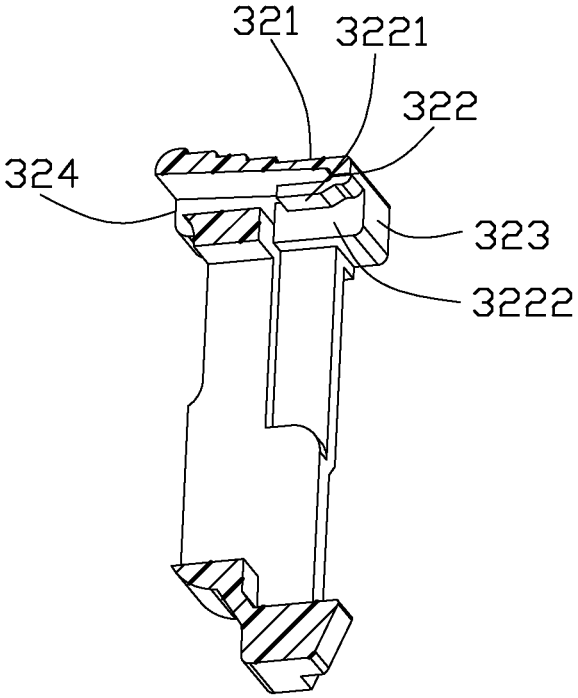
FIG. 5 is a cross section view of the lock mechanism taken along a broken line 5-5 in FIG. 4.
Figure 6:
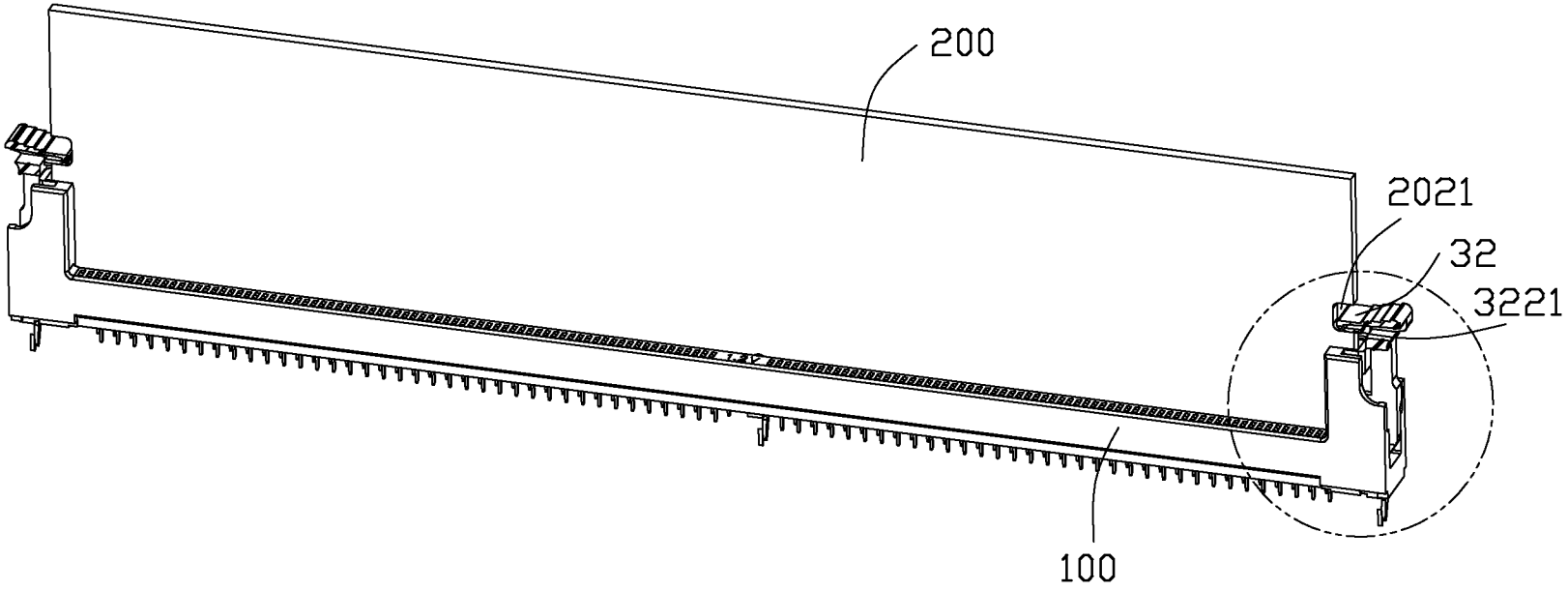
FIG. 6 is a cross section view of the card edge connector taken along a broken line 6-6 in FIG. 1.
Figure 7:
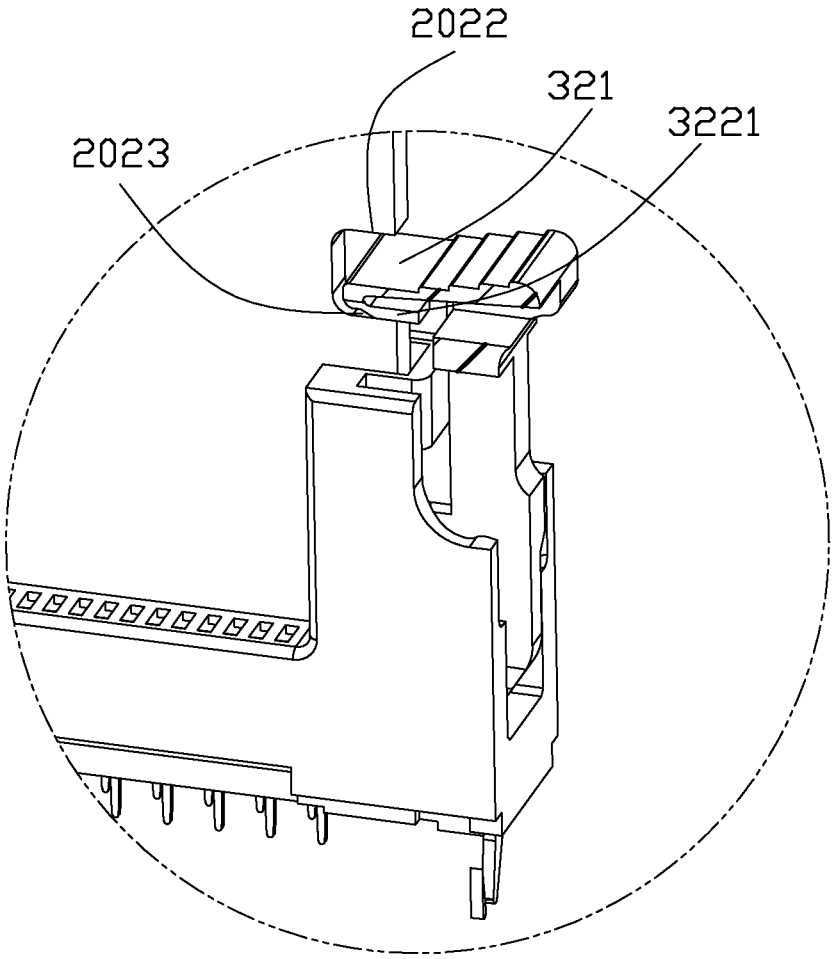
FIG. 7 is an enlarged view of the card edge connector in FIG. 6.

Referring to FIGS. 3 to 4, the card edge connector 100 is a fourth-generation card edge connector, the card edge connector 100 includes more gold-fingers 2011 than existing card edge connector (not shown). The contacting end 201 defines a middle region 203 and two side regions 204 locate at both sides of the middle region 203. In order to reduce insertion force of inserting the daughter card 200, the depth of the middle region 203 is larger than that of each side regions 204. However, while the old problem has been solved, new problems are coming ahead. However, the lock mechanism of the existing card connector (not shown) is prone to wear and tear at work, and wear and tear of the lock mechanism (not shown) cause the daughter card 200 retained unreliable.

Referring to FIGS. 4 to 7, the lock mechanism 3 defines an elastic or deformable projection 3221 projecting from the locking portion 32, the elastic projection 3221 is an elastic arm. The locking portion 32 defines an upper face 321 and a lower face 322 opposite to the upper face 321, an inner face 323 and an outer face 324 opposite to the inner face 323, the elastic projection 3221 projects from the lower face 322, further more, the elastic projection 3221 projects from the front face 323 to the rear face 324. The opening 2021 defines an upper surface 2022 and a lower surface 2023, the elastic projection 3221 elastically presses on the lower surface 2023. So the daughter card 200 can be retained reliably via the elastic projection 3221 downwardly pressing the daughter card 200 even if the elastic projection 3221 wear and tear. Notably, the upper face 321 provides a finger operation area for the user to manually rotate the locking mechanism 3.

Referring to FIG. 4, the locking portion 32 further includes two clamping walls 3222 located at opposite sides of the lower face 322, the clamping wall 3222 projects from the lower face 322 and extends beyond the elastic projection 3221, the clamping wall 3222 is used for protecting the elastic projection 3221. Thus, the daughter card 200 can be retained between the two clamping walls 322. The height of the locking portion 32 is lower than the opening 2021 and then a gap is formed between the upper face 321 of the locking portion 32 and the upper surface 2022 of the opening 2021. Thus, the elastic projection 3221 can be more effectively pressing the daughter card 200.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector, comprising:

an elongated insulative housing having a central slot for insertion of a daughter card and a pair of end portions located at opposite sides of the central slot respectively;

a plurality of terminals retained in the housing and protruded into the central slot for mating with the daughter card; and at least one lock mechanism pivoted at one end portion for locking with the daughter card; wherein at least one lock mechanism pivoted at one end portion for locking with the daughter card; wherein the lock mechanism has a locking portion for locking the daughter card and an elastic projection projecting from the locking portion for downwardly pressing the daughter card; wherein said elastic projection integrally extends from a lower face of the locking portion.

2. The card edge connector as claimed in claim 1, wherein the locking portion defines two clamping walls on opposite side of the lower face for holding the daughter card, the elastic projection is located between said two clamping walls.

3. The card edge connector as claimed in claim 2, wherein said locking portion further defines an inner face and an outer face, said elastic projection extends from the inner face to the outer face.

4. The card edge connector as claimed in claim 3, wherein the clamping wall projects from the lower face and extends beyond the elastic projection.

5. The card edge connector as claimed in claim 4, wherein said lock mechanism define a main portion having an upper end and a lower end, said locking portion integrally extends from the upper end of the main portion, the lock mechanism further defines an ejecting portion extending from the lower end for ejecting the daughter card out of the central slot.

6. The card edge connector as claimed in claim 1, wherein said elastic projection is cantilevered with a free end communicatively facing outwardly toward an exterior.

7. A card edge connector assembly comprising:

a daughter card defines two opposite sides and at least one opening formed on one side of the daughter card, said opening defines an upper surface and a lower surface opposite to the upper surface;

a card edge connector defines an insulative housing having a central slot for receiving the daughter card therein, a plurality of terminals disposed in the housing for engagement with the daughter card, at least one lock mechanism pivoted at one end portion for locking with the daughter card; wherein said lock mechanism defines a locking portion latching into the opening and an elastic projection extending from the locking portion, said elastic projection pressed on the lower surface of the opening for downwardly pressing the daughter card; wherein said elastic projection integrally extends from a lower face of the locking portion.

8. The card edge connector assembly as claimed in claim 7, wherein two clamping walls are formed on opposite sides of the lower face for holding the daughter card, said elastic projection is located between said two clamping walls.

9. The card edge connector assembly as claimed in claim 7, wherein a gap is formed between an upper face of the locking portion and the upper surface of the opening when the locking portion locking with the daughter card.

10. The card edge connector assembly as claimed in claim 7, wherein the clamping wall extends from the lower face and extends beyond the elastic projection.

11. The card edge connector assembly as claimed in claim 7, wherein said elastic projection is cantilevered with a free end communicatively facing outwardly toward an exterior.

12. A card edge connector assembly comprising:

an elongated insulative housing extending along a longitudinal direction;

a receiving slot formed in the housing along said longitudinal direction in communication with an exterior in a vertical direction perpendicular to said longitudinal direction;

a plurality of contacts disposed in the housing with contacting sections extending into the receiving slot in a transverse direction perpendicular to both said longitudinal direction and said vertical direction;

at least one tower located at one end of the housing in said longitudinal direction; and an ejector pivotally disposed in the tower between an inner locking position and an outer unlocking position, and including an upper locking section and a lower ejecting section opposite to each other; wherein the upper locking section forms a deformable projection which is in a relaxed manner at the outer unlocking position while is deformed, at the inner locking position, for applying a downward resilient force, along said vertical direction, upon a daughter card which is adapted to be received in the receiving slot; wherein the deformable projection is an elastic arm; wherein said elastic arm is cantilevered with a free end communicatively facing outwardly to an exterior away from the receiving slot in the longitudinal direction.

13. The card edge connector assembly as claimed in claim 12, wherein the ejector is configured to have said deformable projection protectively unexposed upwardly to the exterior in said vertical direction.

14. The card edge connector assembly as claimed in claim 12, wherein the ejector is configured to have said deformable projection protectively unexposed to the exterior in said transverse direction.

15. The card edge connector assembly as claimed in claim 14, wherein the upper locking section includes a pair of clamping walls not only to protect said deformable projection in the transverse direction but also to sandwich the daughter card therebetween in said transverse direction.

16. The card edge connector assembly as claimed in 12, wherein said deformable projection downwardly abuts against a bottom surface of a notch in a side of said daughter card.

17. The card edge connector assembly as claimed in claim 12, wherein the upper locking section provides an upward finger operation area which is rigid and not deformable.

18. The card edge connector assembly as claimed in claim 12, wherein said elastic arm is integrally formed with the upper locking section.

19. The card edge connector assembly as claimed in clam 18, wherein said elastic arm extends from a lower face of the upper locking portion.

* * * * *